US005374856A

United States Patent [19]

Zink et al.

[11] Patent Number: 5,374,856

[45] Date of Patent: Dec. 20, 1994

[54] TIMER MOTOR INCREMENTAL DRIVE

[75] Inventors: David E. Zink; Michael A. Naylor, both of Indianapolis; Leslie S. Jordan, Spencer, all of Ind.

[73] Assignee: Emerson Electric Co., St. Louis, Mo.

[21] Appl. No.: 975,055

[22] Filed: Nov. 12, 1992

[51] Int. Cl.[5] ..... H01H 3/00

[52] U.S. Cl. ..... 307/140; 307/141.4; 307/141

[58] Field of Search ..... 307/112, 116, 125, 139, 307/140, 141, 141.4

[56] References Cited

U.S. PATENT DOCUMENTS

| | | | |
|---|---|---|---|
| Re. 29,086 | 12/1976 | Murphy et al. | 307/141 |
| 3,609,390 | 9/1971 | Feldman | 307/307 |
| 3,760,189 | 9/1973 | Jones, Jr. | 307/120 |
| 4,362,953 | 12/1982 | Bolin | 307/141 |
| 4,857,758 | 8/1989 | Rigazio et al. | 307/140 |

*Primary Examiner*—Jeffrey A. Gaffin

*Attorney, Agent, or Firm*—Robert F. Meyer; Eric R. Waldkoetter

[57] ABSTRACT

An appliance timer incremental drive is provided with an electronic circuit that generates a nonvarying camstack motor advancement pulse that cooperates with a cam-operated motor control switch. When the motor control switch is closed, a power circuit is completed with a camstack drive motor and the camstack rotates. When the motor control switch opens, the power circuit is also open, so the camstack is stationary. The camstack remains stationary, delayed, until the electronic circuit, which operates independently from the camstack, provides a nonvarying camstack advancement pulse to power the camstack drive motor to rotate the camstack.

14 Claims, 7 Drawing Sheets

TIMER MOTOR INCREMENTAL DRIVE

BACKGROUND OF THE INVENTION

This invention relates to a cam-operated appliance timer. More specifically, a cam-operated appliance timer that employs a nonvarying electrical pulse cooperating with a cam-operated switch to incrementally advance and to delay rotation of a camstack.

Prior art cam-operated timer electronic incremental drive systems employ electronic circuits that are responsive to the camstack by using a program input or feedback from the camstack and provide an electronic pulse of variable duration. Such electronic incremental drive systems employ a sensor means for determining camstack position and provide information on camstack position to an electronic pulsing circuit. The electronic pulsing circuit can then generate a pulse of the proper duration to power the camstack drive motor.

An electronic feedback motor control circuit is complex and costly to manufacture. Additionally, electronic feedback motor control circuits have been unreliable because if there is an error in determining camstack position the timer's performance can be degraded or may cause the timer to malfunction.

A less complex and less expensive alternative to the electronic feedback motor control circuit would decrease production costs and increase the reliability of the cam-operated timer, yet provide the advantages of an electronic incremental drive such as increased accuracy due to the precision of electronically timed pulses, rapid camstack advance using a single motor, and a delay feature.

SUMMARY OF THE INVENTION

Accordingly there is provided a cam-operated appliance timer incremental drive, comprising: a motor; a camstack driven by the motor having a motor control cam; a cam-operate switching means responsive to the camstack; and, an electronic pulsing circuit connected in parallel with the cam-operated switching means that provides a nonvarying camstack drive motor advancement pulse.

DETAILED DESCRIPTION OF THE DRAWINGS

Figure 1:
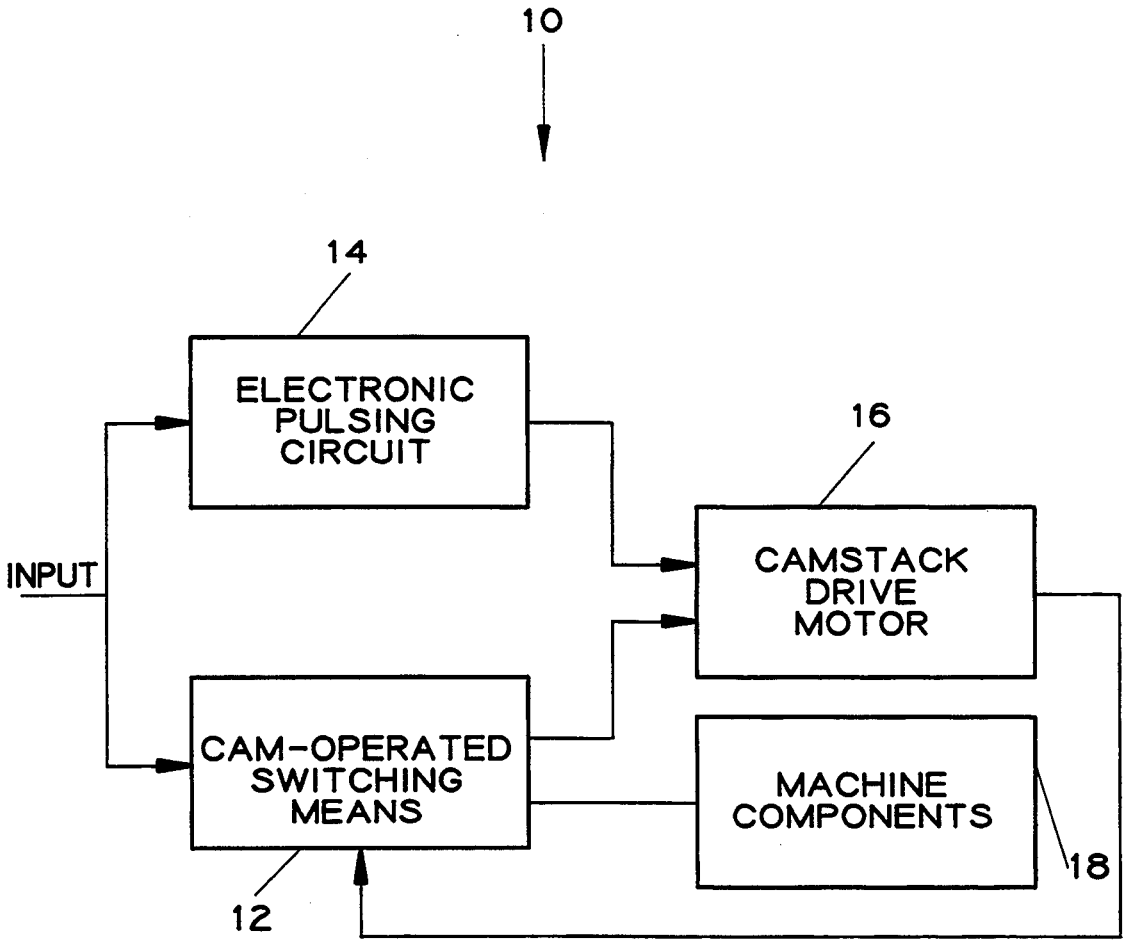
FIG. 1 is a block diagram of the invention.

Referring to FIG. 1, the cam-operated appliance timer incremental drive 10 comprises: cam-operated switching means 12; an electronic pulsing circuit 14; a camstack drive motor 16; and, machine components 18.

Figure 2:
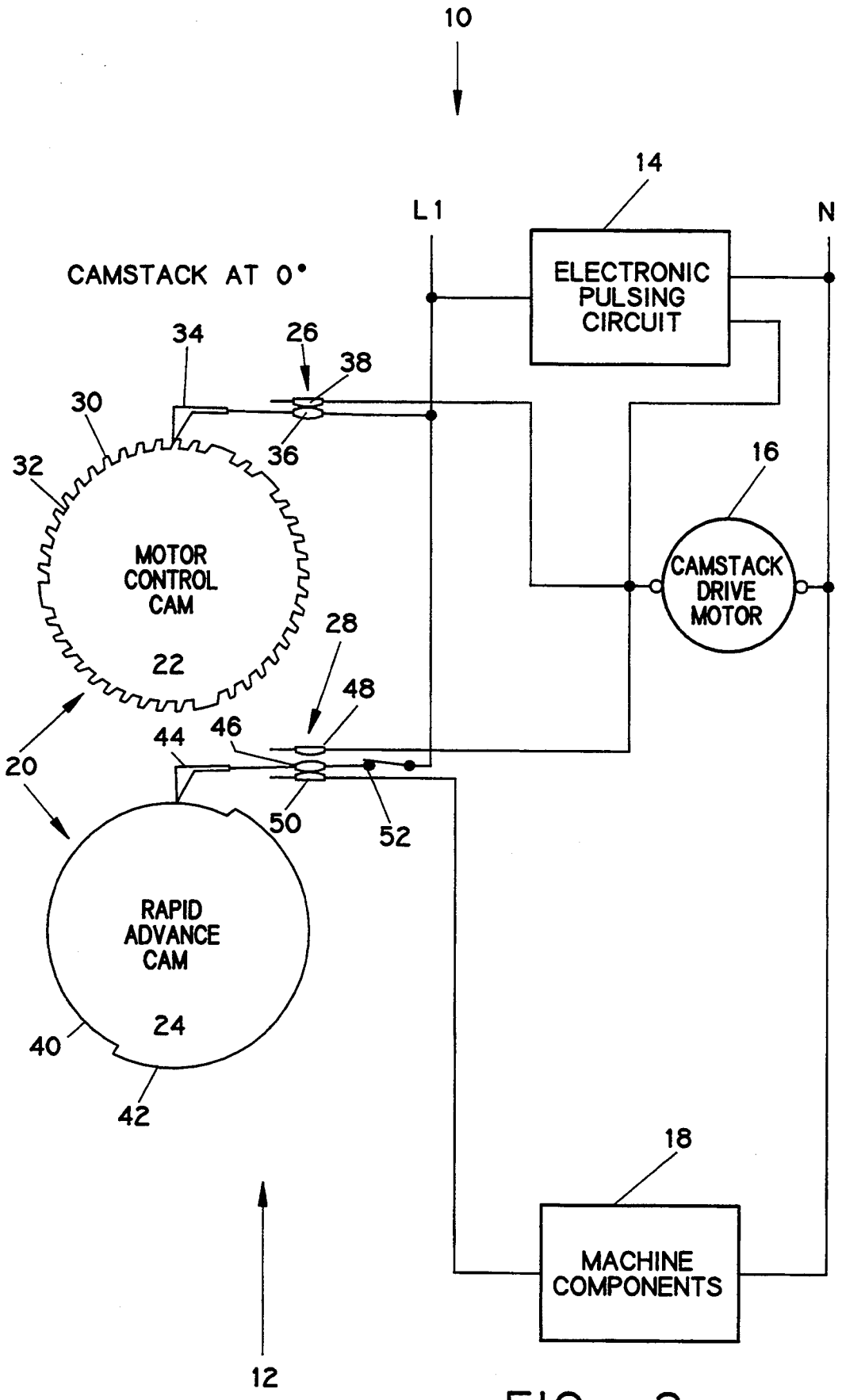
FIG. 2 shows a camstack at 0°.

Referring to FIG. 2, the cam-operated switching means 12 further comprises a camstack 20, a motor control cam 22, a rapid advance cam 24, a motor control switch 26, and a rapid advance switch 28. The camstack 20 is driven by the camstack drive motor 16 for rotation. The motor control cam 22 is carried on the camstack 20 and has a top profile 30 and a bottom profile 32. The motor control switch 26 is responsive to the motor control cam 22 and includes a motor control cam follower 34, a motor control cam follower contact 36 connected to L1 and a camstack drive motor contact 38 connected to the camstack drive motor 16.

The rapid advance cam 24 is carried on the camstack 20 and has a machine components profile 40 and a rapid advance profile 42. The rapid advance switch 28 is responsive to the rapid advance cam 24 and includes a rapid advance cam follower 44, a rapid advance cam follower contact 46, a rapid advance contact 48, and a machine components contact 50. The rapid advance contact 48 is connected to the camstack drive motor 16; the machine components contact 50 is connected to machine components 18; and, the rapid advance cam follower contact 46 is connected to function switch 52. Function switch 52 is connect to L1 and is opened to disable the rapid advance switch 28 and closed to enable the rapid advance switch 28. Function switch 52 would typically be mounted in an appliance control console, so an appliance operator could open or close the switch to select an appliance function such as a cleaning cycle.

Figure 5:
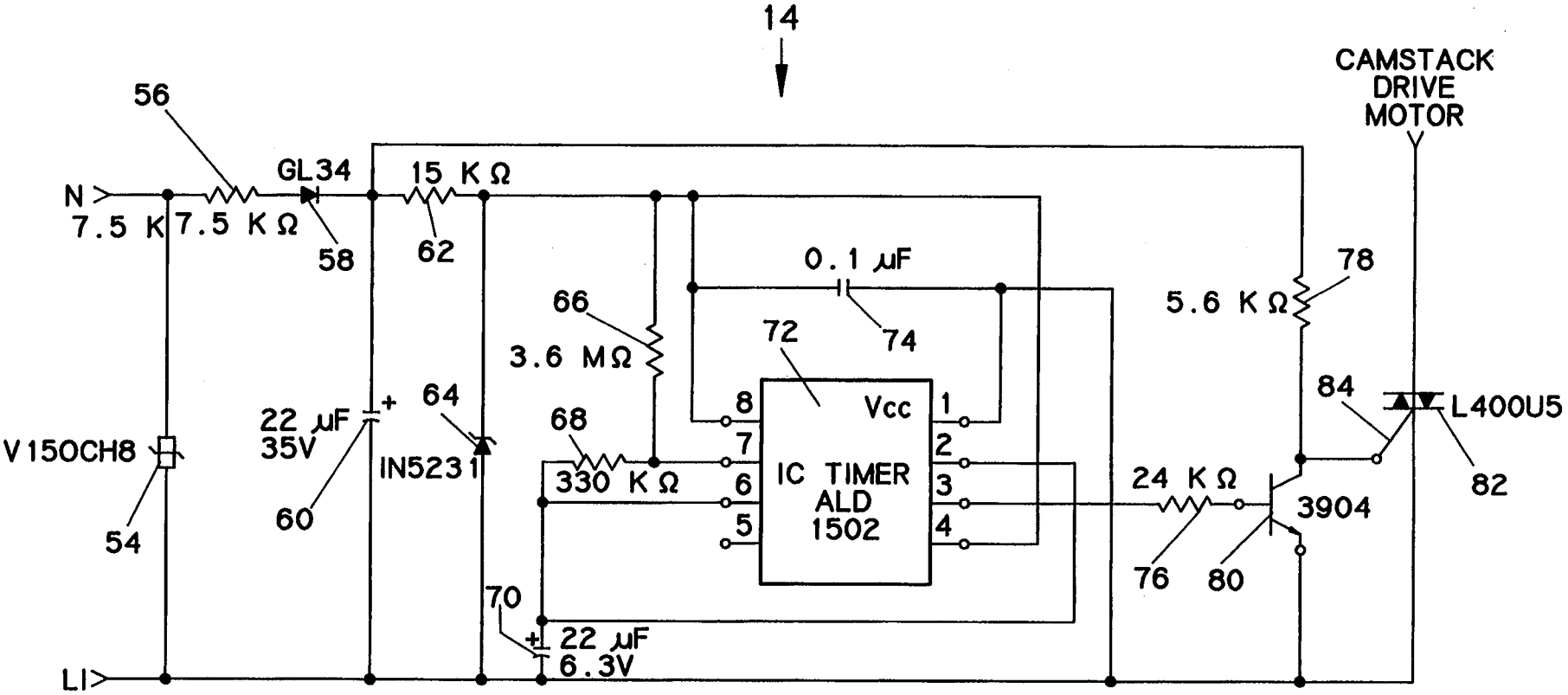
FIG. 5 is a schematic of an electronic pulse circuit.

Referring to FIG. 5, the electronic pulsing circuit 14 comprises: a DC power supply; an integrated circuit configuration circuit; and, a motor switching circuit. Line terminals L1 and N are connected to AC line and AC neutral respectively.

The DC power supply includes varistor 54, resistor 56, diode 58, capacitor 60, resistor 62, and Zener diode 64. Varistor 54 is connected across L1 and N to suppress transient voltages to prevent damage to circuit components. Resistor 56 is connected in series with diode 58 and limits current to diode 58 and capacitor 60. Diode 58 is a half-wave rectifier and capacitor 60 serves as a filter. Resistor 62 is also a current limiting resistor that cooperates with Zener diode 64 to establish $V_{cc}$ at approximately 5 VDC.

The integrated circuit (IC) configuration circuit includes the resistor-capacitor (RC) network of resistor 66, resistor 68, and capacitor 70. Values of the RC network can be modified to vary the duty cycle of the pulse the electronic pulsing circuit 14 will generate. Capacitor 74 serves to suppress noise at $V_{cc}$. The IC 72 is an Advanced Linear Devices (ALD) 1502 high speed micropower timer configured in the astable mode as a free running oscillator.

Figure 6:
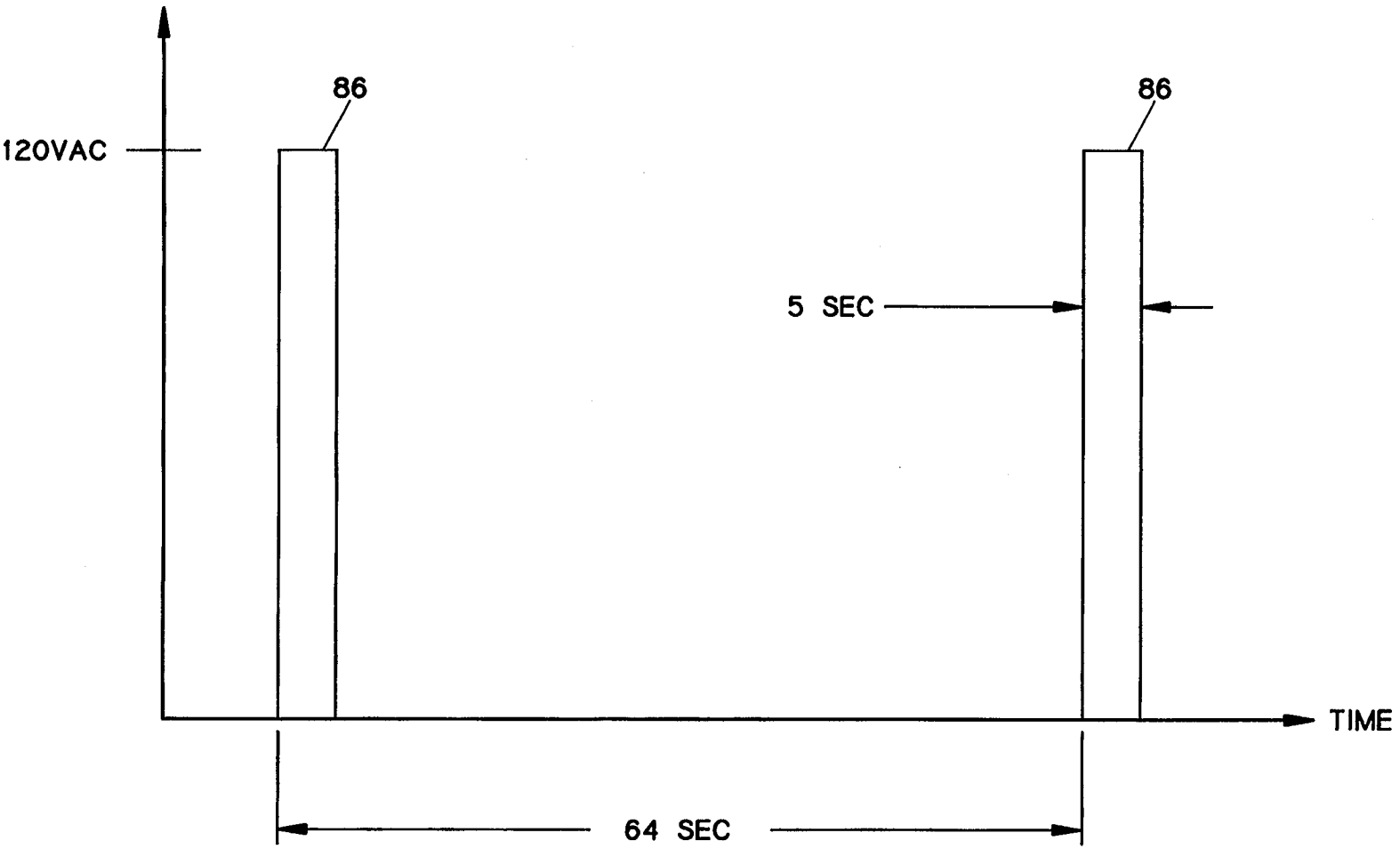
FIG. 6 is a camstack drive motor advancement pulse diagram.

The motor switching circuit includes resistor 76, resistor 78, transistor 80, and triac 82 having triac gate 84. Resistors 76 and 78 are current limiting resistors. Transistor 80 is a switching transistor. When IC 72 pin 3 is high, transistor 80 is "on" thus keeping triac gate 84 low enough to maintain triac 82 "off" preventing current flow to the camstack drive motor 16. When IC 72 pin 3 goes low, transistor 80 turns "off" causing triac gate 84 to go high enough to turn triac 82 "on" allowing current flow to the camstack drive motor 16. Referring to FIG. 6 the electronic pulsing circuit 14 (FIG. 5) as configured will generate a five (5) second camstack drive motor advancement pulse every sixty-four (64) seconds. There is no feedback from the cam-operated switching means 12 to the electronic pulsing circuit 14 (FIG. 1).

Referring to FIG. 2, the camstack drive motor 16 is a synchronous fractional horsepower motor. Machine components 18 refers to an appliance component other than a timer such as a pump, motor, heater, or fill valve.

Operation of the invention is now described. Referring to FIG. 2, when the camstack 20 is at 0° the motor control switch 26 is closed completing a circuit between L1 and the camstack drive motor 16 to provide power for rotation of the camstack 20. The rapid advance cam follower contact 46 is making contact with the machine component's contact 50 and since function switch 52 is closed a circuit is completed between L1 and machine components 18 providing power to machine components 18.

Figure 7:
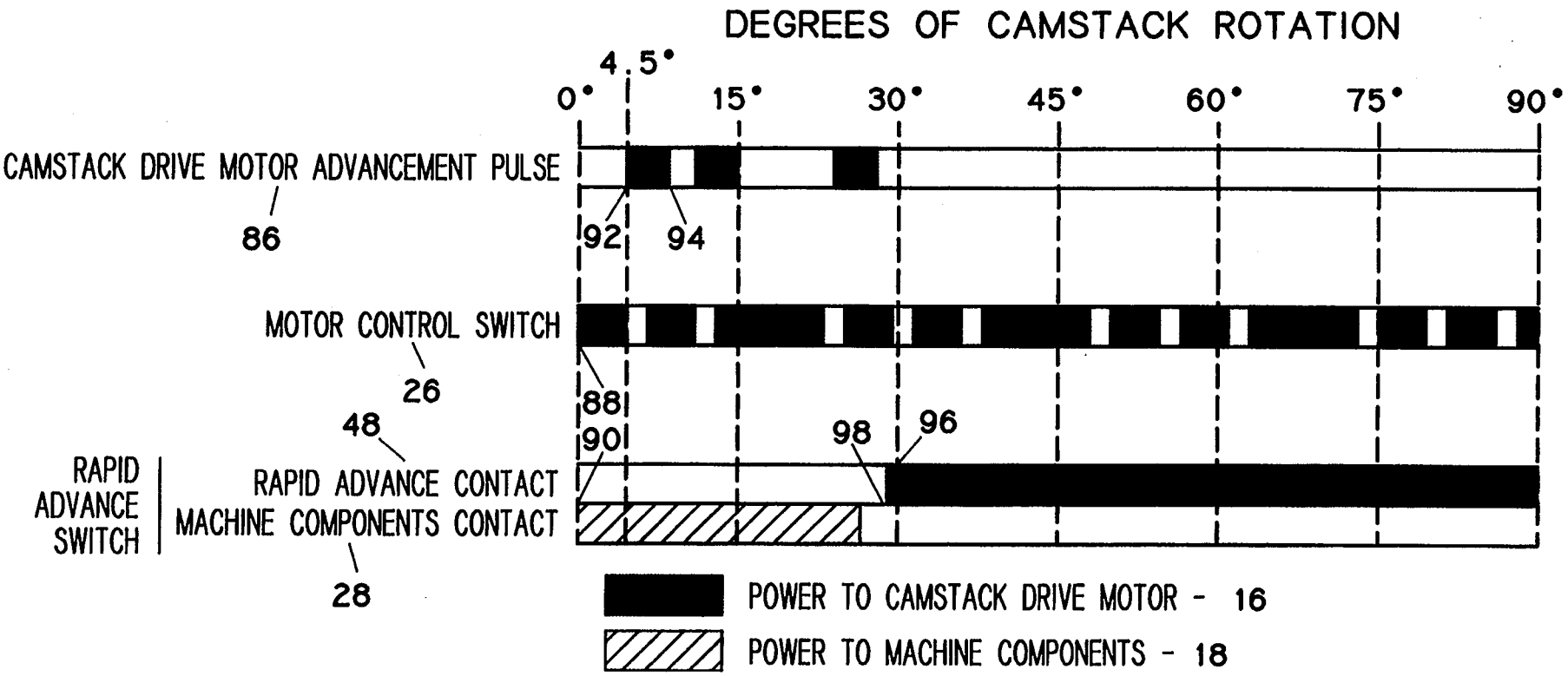
FIG. 7 is a camstack rotation diagram.

Referring now to FIG. 7, a camstack rotation diagram (not a camstack timing diagram), which displays functions of the camstack drive motor advancement pulse 86, the motor control switch 26, and the rapid camstack advance switch 28 in relation to degrees of camstack rotation. Functioning of the camstack drive motor advancement pulse 86 and motor control switch 26 are displayed next to each other to show their cooperation in providing power to the camstack drive motor 16. The rapid camstack advance switch 28 is shown activated with function switch 52 closed.

At 0° of camstack rotation, the camstack drive motor advancement pulse 86 is not providing power to the camstack drive motor 16. The motor control switch 26 is providing power 88 to the camstack drive motor 16. The rapid advance switch 28 is providing power 90 to machine components 18.

Figure 3:
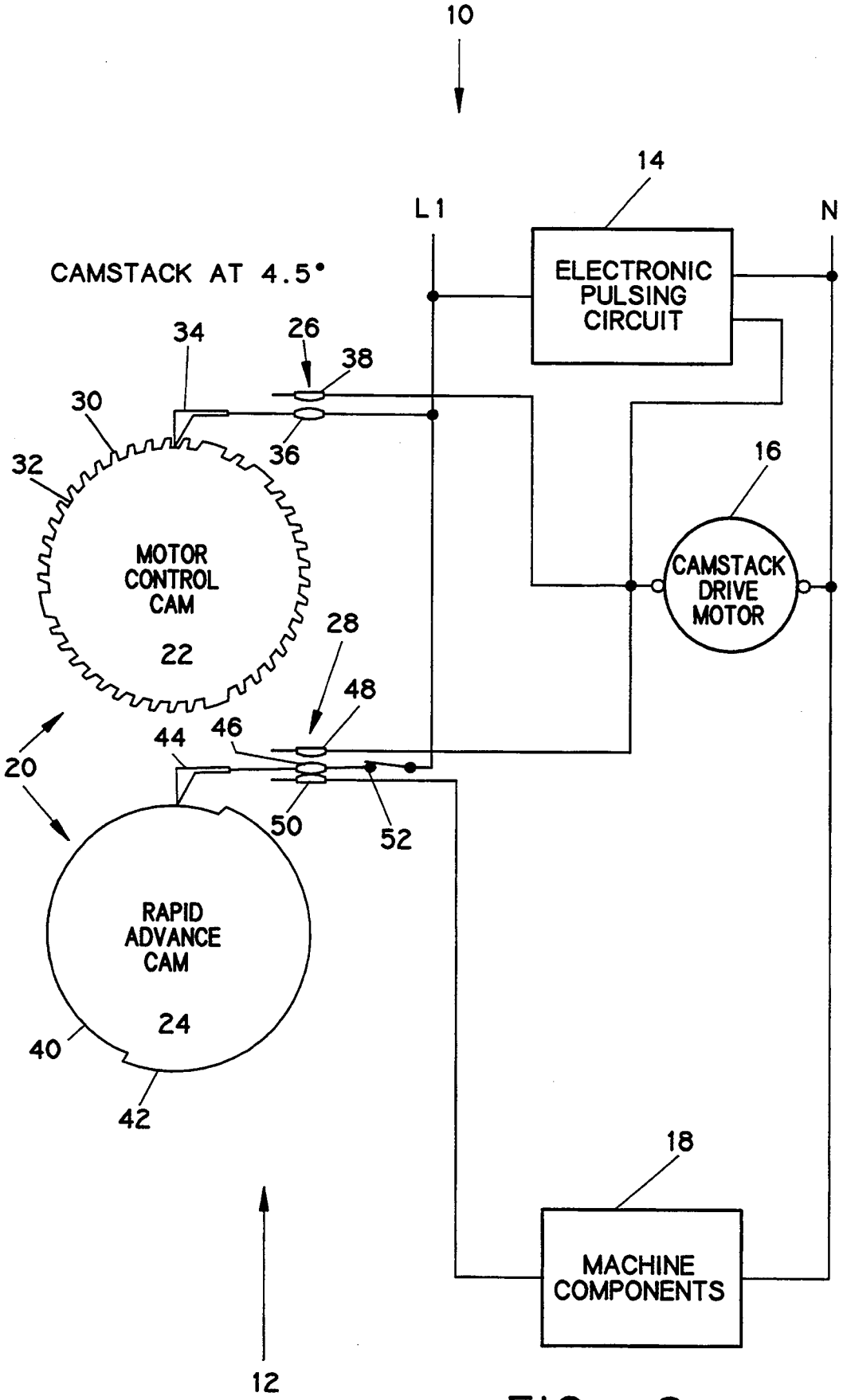
FIG. 3 shows the camstack at 4.5°.

Referring to FIG. 3, when the motor control cam is at 4.5° the motor control cam follower 34 has dropped to the bottom profile 32, so the motor control switch 26 is open. With motor control switch 26 open, the circuit between L1 and the camstack drive motor 16 is open; therefore, the motor control switch 26 is not providing power to the camstack drive motor 16. When motor control switch 26 is open the camstack drive motor 16 must wait for a camstack drive motor advancement pulse 86 (FIG. 6) from the electronic pulsing circuit 14 to power the camstack drive motor 16 to rotate the camstack 20. Since the electronic pulsing circuit 14 as configured provides a five (5) second camstack drive motor advancement pulse every sixty-four (64) seconds, a time delay will occur before the electronic pulsing circuit 12 provides power to the camstack drive motor 16 for rotation. When the camstack drive motor advancement pulse 86 (FIG. 6) is provided to the camstack drive motor 16, the camstack drive motor advancement pulse 86 (FIG. 6) will rotate the camstack at least the number of degrees required for the motor control cam follower 34 to rise to the top profile 30 and close the motor control switch 26. The rapid advance cam follower contact 46 and machine components contact 50 remain closed providing power to machine components 18.

Referring to FIG. 7, at 4.5° of camstack 20 rotation the camstack drive motor advancement pulse 86 now provides power 92 to the camstack drive motor 16 for rotation of the camstack 20. The camstack drive motor advancement pulse 86 will provide power to rotate the camstack 20 farther than necessary for the motor control switch 26 to close and provide power to the camstack drive motor 16. The camstack drive motor advancement pulse 86 overdrives 94 the camstack drive motor 16 to compensate for mechanical tolerances. The motor control switch 26 no longer provides power to the camstack drive motor 16. The rapid advance switch 28 continues to provide power to machine components 18.

Figure 4:
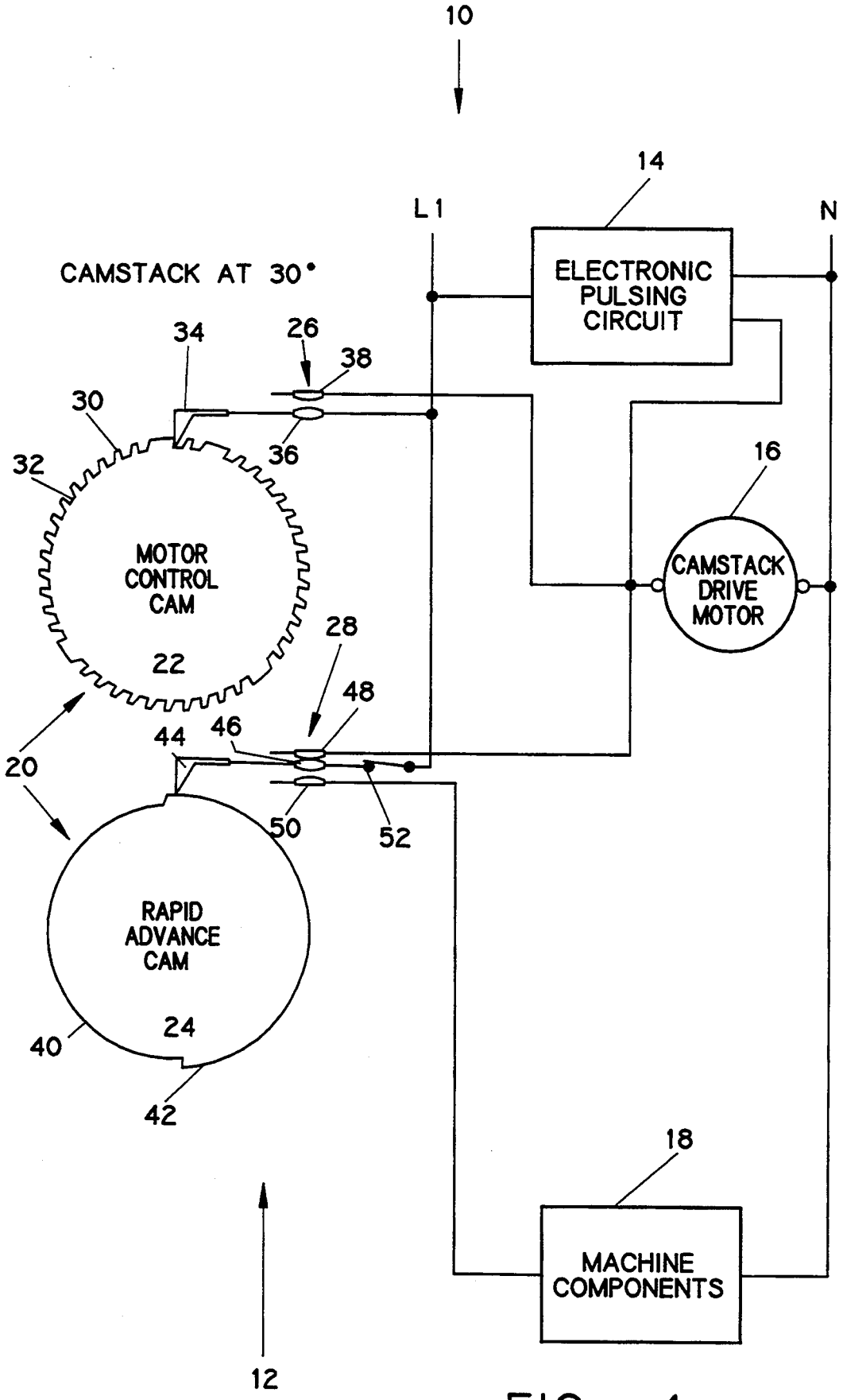
FIG. 4 shows the camstack at 30°.

Referring to FIG. 4, when the camstack 20 is at 30° the motor control cam follower 34 is on the bottom profile 32, so the motor control switch 26 is open and not providing power to the camstack drive motor 18. The rapid advance cam follower 44 has risen to the rapid advance profile 42 causing the rapid advance cam follower contact 46 to close with the rapid advance contact 48 and now provides power to the camstack drive motor 16 to rotate the camstack 20, and the rapid advance switch 28 no longer provides power to machine components 18.

Referring to FIG. 7, at 30° of camstack 20 rotation the camstack drive motor advancement pulse 86 is no longer providing power to the camstack drive motor 16. Also the motor control switch 26 does not provide power to the camstack drive motor 16. The rapid advance switch 28 now provides power 96 to the camstack drive motor 16, and the rapid advance switch 28 no longer provides power to machine components 18. Referring to FIG. 4, the rapid advance switch 28 stops providing power to machine components 18 prior to application of power to the camstack drive motor 16. This is caused by the degrees of rotation required for the rapid advance cam follower 44 to rise and close the rapid advance cam follower contact 46 with the rapid advance contact 48.

What is claimed is:

1. A cam-operated appliance timer incremental drive, comprising:

(a) a motor;

(b) a camstack driven by said motor having a motor control cam;

(c) cam-operated switching means responsive to said camstack having a motor control switch responsive to said motor control cam providing power to said motor for rotation of said camstack; and, (d) an electronic pulsing circuit connected in parallel with said cam-operated switching means and operating independently from said camstack providing a nonvarying pulse to said motor for rotation of said camstack.

2. A cam-operated appliance timer incremental drive as recited in claim 1 wherein when said motor control switch is closed said motor operates continuously.

3. A cam-operated appliance timer incremental drive as recited in claim 1 wherein when said motor control switch is open said motor operates when provided said nonvarying pulse from said electronic pulsing circuit.

4. A cam-operated appliance timer incremental drive as recited in claim 1 wherein when said motor control switch is open a time delay occurs prior to said motor receiving said nonvarying pulse.

5. A cam-operated appliance timer incremental drive according to claim 1, wherein said camstack includes a rapid advance cam and said cam-operated switching means includes a rapid advancement switch responsive to said rapid advancement cam providing power to said motor when said rapid advancement switch is closed.

6. A cam-operated appliance timer incremental drive according to claim 5 wherein said rapid advancement switch can be electrically disconnected with a function switch.

7. A cam-operated appliance timer incremental drive as recited in claim 5 wherein said rapid advancement cam includes a machine components profile and said cam-operated switching means includes a machine components switch for providing power to machine components in an appliance.

8. A cam-operated appliance timer incremental drive as recited in claim 7 wherein said machine components switch can be electrically disconnected with a function switch.

9. A cam-operated appliance timer incremental drive as recited in claim 1 wherein said nonvarying pulse has a constant duty cycle and frequency.

10. A cam-operated appliance timer incremental drive as recited in claim 1 wherein said nonvarying pulse provided to said motor rotates said camstack far enough for said cam-operated switching means to provide power to said motor to rotate said camstack.

11. In a cam-operated appliance timer a method for providing an incrementally driven camstack, comprising the steps of:

(a) providing an electronic pulsing circuit that operates independently from a camstack connected in parallel with a motor control switch selectively engaging said camstack;

(b) generating a nonvarying camstack drive motor advancement pulse with said electronic pulsing circuit;

(c) advancing said camstack when said motor control switch is closed until said motor control switch opens;

(d) delaying advancement of said camstack when said motor control switch is open until said nonvarying camstack drive motor advancement pulse is generated; and, (e) advancing said camstack with a nonvarying camstack drive motor advancement pulse when said motor control switch is open.

12. The method as recited in claim 11, further comprising the steps of:

(a) providing a rapid advance switch connected in parallel with said electronic pulsing circuit, said rapid advance switch selectively engaging said camstack; and, (b) rapidly advancing said camstack when said rapid advance switch is closed until said rapid advance switch opens.

13. The method as recited in claim 11 wherein said rapid advance switch includes a machine components switch that provides power to machine components when said rapid advance switch is open.

14. The method as recited in claim 11 wherein said rapid advance switch and machine components switch can be deactivated with a function switch.

* * * * *